United States Patent [19]

Buck et al.

[11] Patent Number: 4,538,571

[45] Date of Patent: Sep. 3, 1985

[54] REGULATING ARRANGEMENT FOR FUEL ADJUSTING MEANS FOR A SELF-IGNITING INTERNAL COMBUSTION ENGINE

[75] Inventors: Rainer Buck, Tamm; Gerhard Engel, Stuttgart; Thomas Küttner, Stuttgart; Wilfried Sautter, Stuttgart; Wolf Wessel, Oberriexingen, all of Fed. Rep. of Germany

[73] Assignee: Robert Bosch GmbH, Stuttgart, Fed. Rep. of Germany

[21] Appl. No.: 513,984

[22] Filed: Jul. 14, 1983

[30] Foreign Application Priority Data

Sep. 3, 1982 [DE] Fed. Rep. of Germany ..... 3232725

[51] Int. Cl.[3] ..... F02D 1/04; F02D 11/10

[52] U.S. Cl. ..... 123/357; 123/352; 74/859; 180/170

[58] Field of Search ..... 123/352, 357, 353, 354, 123/355, 358, 359; 74/859; 180/170, 176, 179

[56] References Cited

U.S. PATENT DOCUMENTS

| | | | |
|---|---|---|---|
| 3,425,401 | 2/1969 | Lang | 123/357 |
| 3,716,035 | 2/1973 | Adler et al. | 123/357 |
| 3,886,915 | 6/1975 | Taplin | 123/352 |
| 3,939,738 | 2/1976 | Abey | 74/859 |
| 3,963,091 | 6/1976 | Noddings | 123/357 |
| 3,973,537 | 8/1976 | Williams | 123/357 |
| 4,036,193 | 7/1977 | Kobayashi | 123/357 |
| 4,279,229 | 7/1981 | Arnold | 123/357 |

*Primary Examiner*—Ronald B. Cox

*Attorney, Agent, or Firm*—Michael J. Striker

[57] ABSTRACT

Disclosed a regulating device for a fuel volume adjuster of a self-igniting internal combustion engine. In order to damp jerking movements resulting at different power transmissions, a signal corresponding to the actual rotary speed of the engine is fed back into an electronic regulating circuit. Preferably, the feedback path includes a phase shifter. It is essential that the regulating action of the rotary speed be not delayed by the phase turning shifter. For this purpose, the electronic regulating circuit includes a PI stage and the fed back signal is applied to the regulating circuit only after its I-constituent has become effective.

12 Claims, 7 Drawing Figures

REGULATING ARRANGEMENT FOR FUEL ADJUSTING MEANS FOR A SELF-IGNITING INTERNAL COMBUSTION ENGINE

BACKGROUND OF THE INVENTION

The present invention relates in general to fuel volume regulating devices for self-igniting internal combustion engines, and in particular it relates to a regulating device of the type which includes a plurality of sensors for sensing operational parameters of the engine, particularly of the actual fuel dosing and of the actual rotary speed of the engine, a control circuit for producing desired values of the operational parameters of the engine, a comparator for comparing the actual and desired values, and an electronic regulating circuit for the adjuster.

A motor vehicle, due to the elastic suspension of its engine and its gears, represents an oscillatory system which, when exposed to an interference such as for example a jump in the amount of injected fuel in the fuel control device of the engine or due to momentary shocks caused by ambient conditions (holes in the roadway), may be excited to more or less strong oscillations. The frequency of such oscillations is usually between 1 to 8 cycles per second and is sensed as jerking. This jerking movement causes changes in the rotary speed of the engine or relative movement between the engine and the car body.

In electronic injection systems for diesel engines, data such as the position of the accelerator pedal, the rotary speed of the engine, and the like information required for dosing or measuring the volume of fuel, are acquired from a control device. The desired value Uαsoll of the fuel volume computed by the control device in the first course is adjusted on the fuel injection pump by means of a fuel volume adjuster. An electronic sensing system detects signals corresponding to actual operational parameters of the engine, which are processed and applied via suitable delay lines in the adjuster of the regulating circuit. These sensors, however, render the regulating circuit instable or prone to oscillations, which in turn cause again the jerking movements.

In the U.S. Pat. No. 4,345,559 a device for damping jerking oscillations in an internal combustion engine is disclosed. The damping is accomplished in such a manner that regulating oscillations are derived via a differentiating stage from the rotary speed of the engine, and at certain operational characteristics the engine is fed with counteracting control values which neutralize the jerking movements. This counter-control is effected at the frequency of the jerking oscillations and is dependent on the propagation time of the system. This known device makes it possible to achieve a relatively effective damping of the jerking oscillations; nevertheless, it necessitates extremely high expenditures for circuit elements and/or the signal-processing circuitry.

SUMMARY OF THE INVENTION

It is therefore a general object of the present invention to provide for an effective damping of jerking movements with a relatively simple construction.

In keeping with this object and others which will become apparent hereafter, one feature of the invention resides, in a regulating circuit or fuel dose adjuster in a self-igniting internal combustion engine of the above described type, in the provision of a set of sensors for producing signals corresponding to actual operational parameters of the engine, a control circuit for producing signals corresponding to the desired operational parameters of the engine, a subtractor connected to the control circuit and to the sensors to produce a compound difference signal between the desired and actual parameters, and an electronic regulating loop connected between the fuel volume adjuster and the subtractor, the regulating loop including a feedback path for a signal corresponding to an actual rotary speed of the engine.

In comparison with prior art devices of this kind, the regulating arrangement according to this invention has the advantage of faster processing of rotary speed signals, so that delays in the sensing system need not be additionally compensated. By virtue of smaller phase shifts, there result also more stable signals and interference-resistant behavior of the entire device. Moreover, it has been found advantageous that the regulating arrangement of this invention enables a separate optimization of individual regulating components as regards their stationary and dynamic behavior.

The novel features which are considered as characteristic for this invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
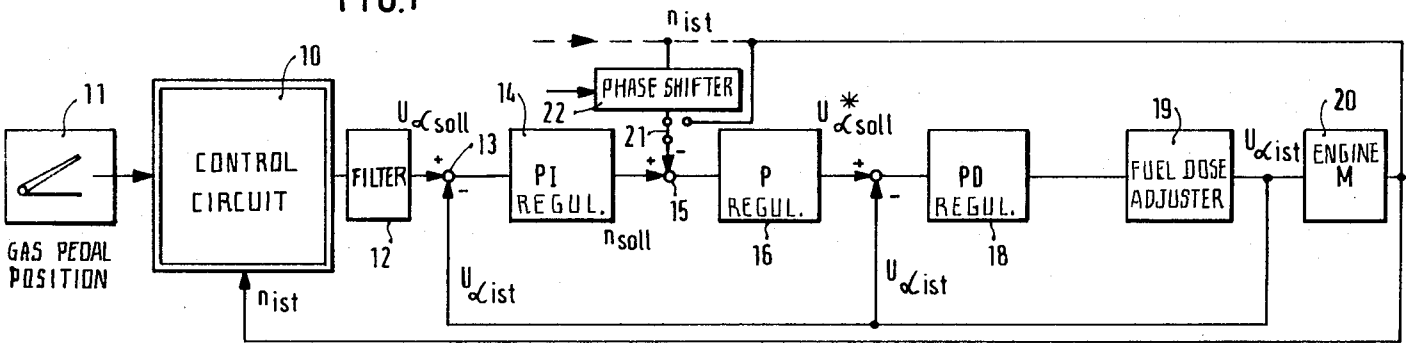
FIG. 1 is a block circuit diagram of the regulating circuit of this invention.

The exemplary embodiments shown in the drawings relate to regulating devices for fuel dose adjusters with a rotary speed feedback in self-ignition internal combustion engines.

In FIG. 1, reference numeral 10 denotes an electronic control device which produces a signal corresponding to the position of an accelerator pedal 11, and a signal $n_{ist}$ from a non-illustrated sensor for the actual rotary speed of the engine. The output of control circuit 10 is connected via filter 12 to a subtractor 13, the output of which is connected to a PI regulator 14. The output $U_{\alpha soll}$ at the filter 12 is an analog voltage signal denoting the desired position value of a fuel dose adjuster; the output signal $n_{soll}$ at the output of the PI regulator corresponds to the desired rotary speed of the engine. The output of the PI regulator 14 is connected to a series connection of a summer 15, P regulator 16, subtractor 17, PD regulator 18, and a volume or dose adjuster 19 of an injection pump which is connected to an internal combustion engine 20. The signal $n_{ist}$ is produced by a non-illustrated sensor at the output of the engine 20 and this signal corresponding to the actual rotary speed of the engine, is fed to the input of the aforementioned electronic control device 10. Another sensor for producing a signal $U_{\alpha ist}$ is arranged at the connection between the output of adjuster 19 and the engine 20, and this signal is applied to respective minus inputs of subtractors 13 and 17.

The minus input of the subtractor 15 is connected to a double-throw switch 21 which enables either the direct application of the signal $n_{ist}$ from the output of the engine 20 or selectively connects the $n_{ist}$ signal via a phase shifter 22 to the minus input of the subtractor 15.

In the embodiment of the regulating arrangement for the fuel adjuster according to FIG. 1, there is provided a regulating loop consisting of three interconnected regulating subcircuits. The intermediate regulating subcircuit includes a proportional-differential (PD) regulator 18 which takes care for fast adjustment of the regulating path, that is of the position of the fuel dose adjusters to the desired value $U_{\alpha soll}$. The P-regulator 16 is assigned to the rotary speed regulation path and takes care for fast adjustment of the desired value n of the rotary speed. In order to facilitate correct adjustment of the position signal $U_{\alpha soll}$ of the fuel dose adjuster 19 under stationary conditions, there is provided a relatively slow PI-regulator 14 whose I component provides for an after-regulation for so long until the desired condition of the adjuster 19 corresponds to the actual position. By means of this structural design, it is guaranteed that the injection pump receives the requisite information regarding the specific rotary speed in the fastest manner.

It is essential for this invention that a rotary speed regulator is provided after a regulator having a I component that is that signals carrying information about rotary speed are not delayed by any phase rotating member.

Figure 2:
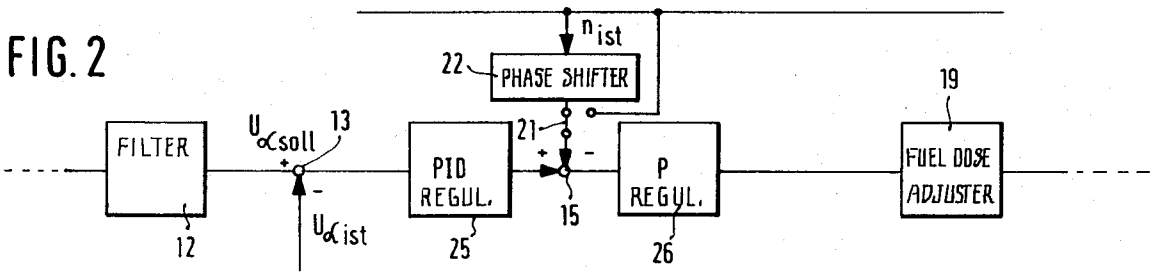
FIG. 2 shows a modification of the circuit of FIG. 1.

Starting at this underlying principle of this invention, FIG. 2 illustrates a simplified version of the regulating arrangement of FIG. 1. Like component parts of the circuit are indicated with identical reference numerals. In the arrangement of FIG. 2, a PID regulator 25 is arranged between subtractors 13 and 15, and a P-regulator 26 is connected to the output of subtractor 15. It is evident from FIG. 2 that the second contact point for the rotary speed signal $n_{ist}$, there is no phase rotating member between the subtractor 15 and the output of the engine 20.

The introduction of a feedback path for the rotary speed signal in the regulating loop for the fuel dose adjuster has also the advantage of optimizing the entire system. As a rule, in the electronic control device there is provided a set of characteristics of the accelerator pedal, from which a dose or volume of fuel can be determined in dependence on the position of the accelerator pedal. In this set of characteristics, dose or fuel volume QK is a function of the rotary speed at a constant acceleration pedal position. In prior art systems this set of characteristics is designed such that a dose of fuel QK in relation to the rotary speed represents a certain, even if weak, countercoupling. By introducing a feedback path for the rotary speed signal in the regulating circuit for the fuel adjuster, the characteristics of the accelerator pedal need now be interpreted only for the stationary operation only. The interpretation for the dynamic operation is performed via the regulating circuit for the fuel dose adjuster. In this manner, the requirements for the stationary and dynamic operational modes can be considered and optimized separately.

Filter 12 provided in either embodiment of FIGS. 1 or 2 at the output of the electronic control device 10 has the function that, in the case of a rotary speed variation, the desired value of the position of the dose adjuster oscillates with the same frequency but at a different phase. In order to prevent interference between the effect of the fast feedback of the rotary speed signal via the regulating circuit and the oscillation at a different phase of the desired accelerator pedal position signal at the output of the control device 10, it is necessary to filter this desired value of the position signal. Depending on the field of application, the filter 12 has the disadvantage that, at a no-load or idling regulation, the corresponding regulator which is provided in the control device 10 may become unstable. In the latter case, it is necessary to apply the output signal from the no-load regulator in the output conduit after the filter 12.

Also depending on a particular application, the phase shifter 22 may become necessary, especially when the jerking motion cannot be satisfactorily damped by the internal rotary speed regulation. This possibility of inclusion of a phase shifter in the feedback loop is made possible by the aforementioned double-throw switch 21. The purpose of the phase shifter 22 is rotate the phase of the rotary speed signal to such an extent until the stability of the regulating circuit is increased. The phase shifter can be represented for example by a proportional-differential regulating member.

Moreover, it is also possible to realize a sort of phase shifter by feeding the actual rotary speed signal via the + input of a subtractor connected to the output of a regulator and via a low-pass filter to the − input of the subtractor. This arrangement acts for low frequencies as a D-member, but as a P-member for higher frequencies (DTA-member). In this manner, a rotary speed signal feedback is achievable, which is free of equal-phase components. The phase turning member 22 makes a dynamic amplification of the fed back rotary speed signal possible.

Figure 3:
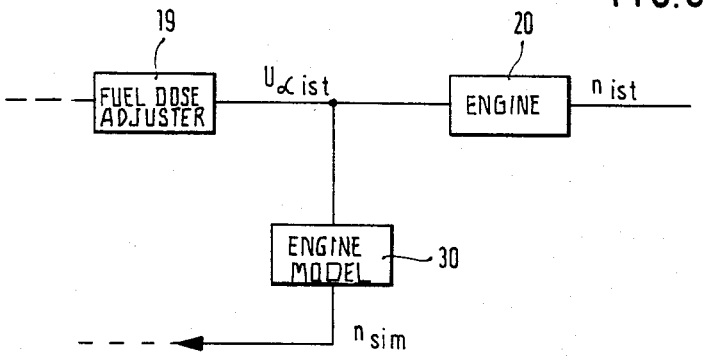
FIG. 3 is a block diagram of a subcircuit of the regulating arrangement employing a rotary speed simulator.

There are numerous prior art techniques for determining the actual rotary speed signals. Considering the basic idea of this invention, the preferred technique is that which enables the fastest detection of the rotary speed. On the other hand, it is also possible to determine the rotary speed from a model of an internal combustion engine in which the specific position of the fuel dose adjuster is simulated. This solution is schematically illustrated in FIG. 3. In this embodiment, the actual fuel dose signal $U_{\alpha ist}$ is applied to a model 30 of the engine which at its output delivers a simulated value of the actual rotary speed. The model 30 in its most simple embodiment can be an integrating member or a time delaying member of the first order with a lower limit frequency. Which of these various possibilities is selected in practical application depends on specific circumstances. The simulator according to FIG. 3 without doubt has the advantage that a rotary speed sensor at the actual engine 20 can be dispensed with. On the other hand, other important operational parameters, such as for example temperature, cannot be considered in such simple simulators. The application of more complex models requires correspondingly increased expenditures on circuit elements and programming technology.

Figure 4:
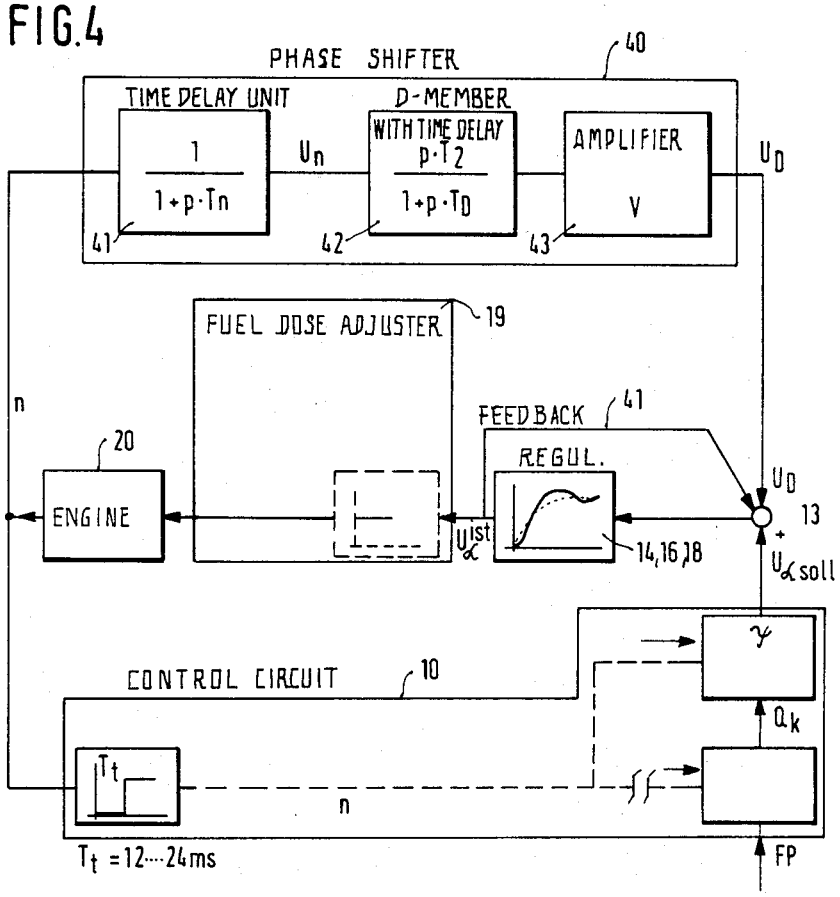
FIG. 4 is another embodiment of the regulating arrangement of this invention.

FIG. 4 shows a schematic circuit diagram of another embodiment of a regulating circuit for a fuel dose adjuster. Even in this example, the circuit elements corresponding to the embodiment of FIG. 1 are designated by like reference numerals. Reference numeral 40 denotes a phase shifting unit acting as a damper of jerking motions. The unit 40 is connected between the rotary speed sensor of engine 20 and a subtractor 13 at the output of electronic control unit 10.

Similarly as in FIG. 1, a complete PID regulator corresponding to subtractors 14, 16 and 18 is connected to a minus input of subtractor 13, and a feedback path 41 from the output of the PID regulator 14, 16 and 18 is connected to the minus input of the subtractor 13.

The damper or phase shifting unit 40 is composed of three sub-units, namely of a time delaying circuit 41, a D-member with a time delaying component 42, and an amplifier 43. The combination of these three sub-units 41–43 provides for a rapid evaluation of the rotary speed (a substitute magnitude for the jerking motion) and to produce an optimum damping of jerking movements by adjusting the frequency range of the phase shifter in dependence on the frequency of jerking movement which in turn is dependent on speed.

FIGS. 5*a*–5*c* explain the behavior of the phase shifting unit 40 of FIG. 4. FIG. 5*a* illustrates in a simplified block diagram the combined amplifying and delaying members 41, 43 followed by the D-member with delaying subcircuit 42.

As will be described below, the essential feature is the frequency response of the feedback through the jerk damper or phase shifting unit 40, which should possess the following characteristics, depicted in the Bode diagrams of FIGS. 5*b* and 5*c*. It will be seen from the diagrams that the frequency dependent member 40 has the following behavior:

The amplification factor F increases with increasing frequency; and the lead phase angle $\phi_o$ decreases with frequency, and these relationships are always valid for the range of jerking frequency depending on the gear shift. The D-member 42, with increasing jerking or vibration frequency during the shiftover from the first to the fourth gear, provides for the correspondingly increased amplification, and its delaying function provides for the additional phase lead. The combination of the two parts is characterized by the course of their characteristic curves (frequency cutoff):

D-time-constant T2: $T2 \approx 1/\omega$ first gear, $\omega = 2\pi f$ in the Bode diagram lies in the proximity of the jerking or vibration frequency at the first gear (greatest reduction gear).

Time delay constant Tn is smaller than or equal to $1/\omega$ fourth gear in the Bode digram lies slightly above the jerking frequency at the fourth gear (smallest reduction gear).

The sharp cutoff or knee of the frequency curve must also lie above the jerking frequency at the fourth gear.

$TD < 1/\omega$ fourth

The time constant of the rotary speed evaluation (filter) is contained in Tn thus resulting in a fast evaluation of the rotary speed.

The unit 40 corrects the jerking in reverse proportion to the gear number or its amplification is proportional to the jerking frequency.

The above values result from the following interrelation:

The amplitude of the jerks or vibrations is larger at larger gear reduction.

The jerking frequency remains at each gear constant.

The jerking frequency attains a lower value with an increased gear reduction, for example in the case of a motor vehicle transmission the frequency range is from 2 to 8 cycles per second.

The jerking frequency and the jerking amplitude therefore are characteristic values for each specific gear. In contrast to the adjustment of the fuel volume without vibration damper, the correction signal from the unit 40 affects both the amplification and the phase of damping of the jerking movements:

The phase lead must be larger with higher gears.

The amplification must increase toward smaller gears (in spite of the fact that the jerking or vibration amplitude is smaller). This can be explained from the gear ratio. The maximum amplification is limited by the stability point, for example of the no-load regulation.

The different jerking movements depending on the shifted gear can be brought under control by this frequency-dependent member with the above features, resulting from the Bode diagrams according to FIGS. 5*b* and 5*c* where optimal damping points pertaining to respective gears are indicated. The amplification increase corresponding to higher jerking frequencies delivers the D-member 42 and The reduced phase lead is produced by the PT1 member 41, 43.

Figure 5:
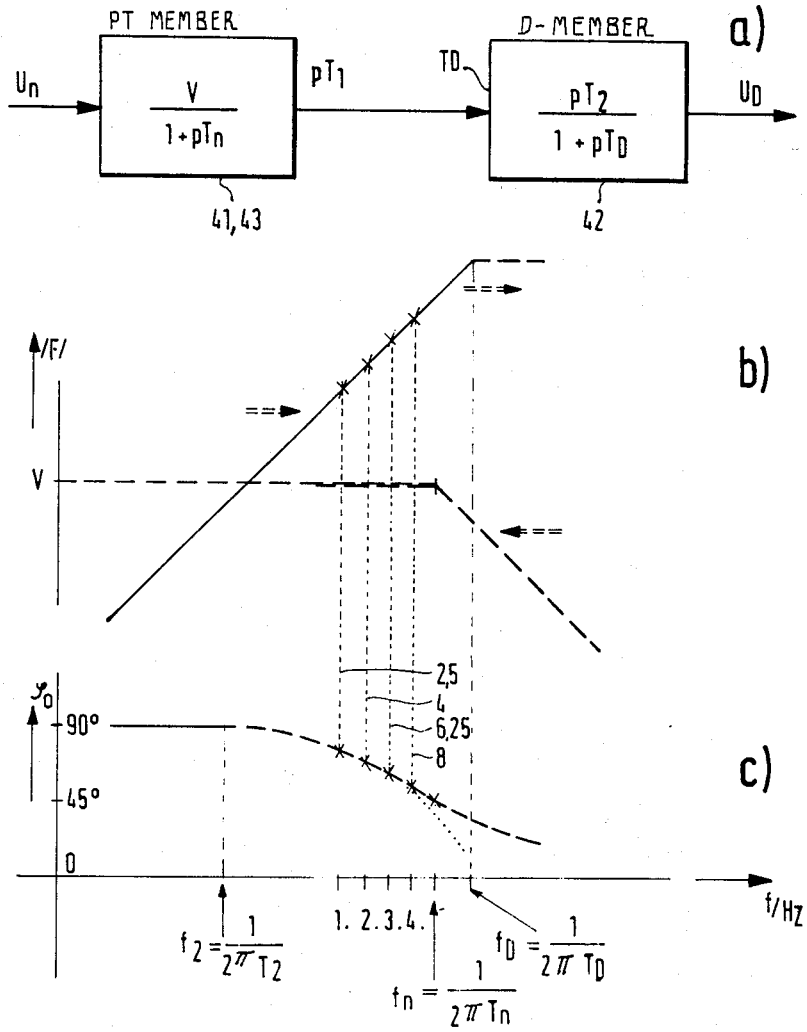
FIGS. 5A–C illustrate explanatory diagrams of the operation of the regulating arrangement of this invention.

Characteristic curves of D-member 42 and the sharp cutoff frequency of the PT-member must be mutually shifted so that the desired course of the PDT curve in the Bode diagram of FIG. 5 is brought into the range of the jerking frequency. The amplification curve and the phase curve should run approximately in proportion to the jerking frequency. Since the jerking frequency and also the correction value necessary for the damping forming the basis of the present optimization and related to the rotary speed change, is to be directly proportional to a reverse value of a gear number and the correction with the above described PDT member can be in general accepted.

The range of the jerking frequency stretches approximately over one decade, and therefore in the Bode diagram the plotting of a summing curve can be made with sufficient approximation as follows:

The sharp cutoff frequency of the PD-member is set in the proximity of the jerking frequency at the smallest gear in order that the arctan course of the phase curve approaches the desired points (possible additional delaying parts must lie above the range of the jerking frequency).

The D-part is set so that the amplitude curve at the jerking frequency cuts off the amplification of the PT member for the first gear. Inasmuch as the actual curves deviate from the asymptotes, the fourth gear thus no longer runs along a straight line under 45°; nevertheless it meets the desired values.

The block diagrams of regulating circuits for fuel volume adjusters according to FIGS. 1, 2 and 4 are close to an analog signal processing circuit. Nonetheless it will be noted that these signal processing circuits can be constructed on a digital basis, whereby the above described functions of respective circuit blocks according to FIGS. 1, 2 and 4 can be performed by suitable digital circuits controlled by a computer program.

It will be understood that each of the elements described above, or two or more together, may also find a useful application in other types of constructions differing from the types described above.

While the invention has been illustrated and described as embodied in a fuel volume regulator for use in diesel engines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A regulating device for an adjuster of a self-igniting internal combustion engine including sensors for producing at least one signal corresponding to actual rotary speed of the engine, comprising control means for generating at least one signal corresponding to a desired rotary speed of the engine, means for comparing the desired and actual rotary speed signals, and an electronic regulating circuit connected between the comparing means and a fuel dose adjuster, said regulating circuit including a phase rotating member and a feedback path for the actual rotary speed signal, said feedback path being coupled to said regulating circuit after said phase rotating member.

2. A regulating device as defined in claim 1, wherein said phase rotating member is a phase shifter.

3. A regulating device as defined in claim 1, wherein said regulating circuit includes a I-regulating stage and the fed back rotary speed regulating signal being connected to the output of this I-regulating stage.

4. A regulating device as defined in claim 1, wherein said control means is an electronic control device cooperating with an accelerator pedal of a motor vehicle and with the sensor for sensing the actual rotary speed of the engine to produce a desired value signal for the fuel volume adjuster, said comparing means including a subtractor for producing a difference signal between the desired and actual values of the fuel volume adjuster, said electronic regulating circuit including PI regulator having an input connected to the difference signal, a P-regulator, a summer connected between the PI regulator and the P-regulator, and said feedback path for the actual rotary speed signal being connected to said summer.

5. A regulating device according to claim 4, wherein said PI regulator is a PID regulator.

6. A regulating device as defined in claim 1, and further including a filter connected between said control means and said comparing means.

7. A regulating device as defined in claim 1, further including a fuel volume adjuster for a fuel injection pump connected to the output of the electronic regulating circuit.

8. A regulating device as defined in claim 1, further comprising a rotary speed simulating circuit for producing a rotary speed simulation signal fed to said control means so as to damp jerking movements resulting from transmission gears.

9. A regulating device as defined in claim 2, for use in a motor vehicle having transmission gears, wherein said phase shifter has a PD(T) frequency characteristic to process the fed back actual rotary speed signal in dependence on the frequency and amplitude of jerking movement at different gears.

10. A regulating as defined in claim 9, wherein the phase shifter has an amplification factor which increases proportionally with the increasing jerking frequency.

11. A regulating device as defined in claim 10, wherein the phase shifter produces a phase lead the value of which is inversely proportional to the jerking frequency.

12. A regulating device as defined in claim 9, wherein the D-part and the sharp cutoff frequency of the PT-part is shiftable in response to the gear ratio whereby the D-part is determined by the lowest jerking frequency depending on the gear and the PT cutoff frequency is above the highest jerking frequency.

* * * * *